United States Patent [19]

Mahabadi et al.

[11] Patent Number: 4,894,308

[45] Date of Patent: Jan. 16, 1990

[54] PROCESS FOR PREPARING ELECTROPHOTOGRAPHIC TONER

[75] Inventors: Hadi K. Mahabadi, Mississauga; Sheau V. Kao; Gerald R. Allison, both of Oakville, all of Canada; Hui Chang, Pittsford; Edward J. Gutman, Webster, both of N.Y.

[73] Assignee: Xerox Corporation, Stamford, Conn.

[21] Appl. No.: 259,239

[22] Filed: Oct. 17, 1988

[51] Int. Cl.[4] ..... G03G 9/08

[52] U.S. Cl. ..... 430/137; 430/110

[58] Field of Search ..... 430/109, 137, 110

[56] References Cited

U.S. PATENT DOCUMENTS

| | | | |
|---|---|---|---|
| 3,893,934 | 7/1975 | Braun et al. | 430/110 |
| 4,110,844 | 8/1978 | Nakamura | 366/76 |
| 4,621,039 | 11/1986 | Ciccarelli et al. | 430/106 |
| 4,649,005 | 3/1987 | Kobayashi et al. | 264/101 |

FOREIGN PATENT DOCUMENTS 1037547 8/1963 United Kingdom .

*Primary Examiner*—John L. Goodrow

*Attorney, Agent, or Firm*—Judith L. Byorick

[57] ABSTRACT

A process for preparing an electrophotographic toner composition which comprises premixing a pigment and a charge control additive in the absence of a solvent, subsequently admixing the premixed pigment and charge control additive and a resin, and extruding the pigment, charge control additive, and resin. The pigment and the charge control additive may be premixed prior to being added to the extruder with the resin; alternatively, the pigment and charge control additive may be premixed by adding them to the extruder via an upstream supply means and extruding them, and subsequently adding the resin to the extruder via a downstream supply means.

35 Claims, 1 Drawing Sheet

PROCESS FOR PREPARING ELECTROPHOTOGRAPHIC TONER

BACKGROUND OF THE INVENTION

The present invention is directed to a process for preparing toners. More specifically, the present invention is directed to a process for preparing toners comprising a resin, a pigment, and a charge control additive, wherein the charge control additive is premixed with the pigment in the absence of a solvent, the mixture is introduced into an extruder and extruded, the resin is subsequently added to the extruder at a port downstream of the port used for introduction of the pigment-charge control additive mixture, and the resulting composition is extruded in the extruder.

Utilization of the extrusion process to prepare toner compositions is known. Extrusion is a continuous process that generally entails dry blending the toner ingredients, placing them into an extruder, melting and mixing the mixture, extruding the material, and reducing the extruded material to pellet form. The pellets are further reduced in size by grinding or jetting, and are then classified by particle size. A typical extrusion apparatus and process are described in copending application U.S. Ser. No. 535,517/83, the disclosure of which is totally incorporated herein by reference. Other known methods of preparing toners include melt blending in a Banbury apparatus, spray drying, dispersion polymerization, solution polymerization, and the like. The extrusion process possesses a number of advantages not present for the Banbury process in that, for example, extrusion is a continuous process rather than a batch process, and in that the extrusion process is more suitable to automation, which allows for more economical operation.

A vent type extruder for extrusion molding of a kind or kinds of resin materials mixed or not mixed with other raw material is disclosed in U.S. Pat. No. 4,110,844. This extruder comprises a heating cylinder with a plurality of ventages formed in open-mouthed relation, with the effective length of an extruding screw to the diameter of the screw at the predetermined ratio of over thirty to one having a range within which resin materials containing a large quantity of moisture and gas may be completely dried up through a single extruding operation without previously appealing to a desiccating treatment. The disclosure of this patent is totally incorporated herein by reference.

British Pat. No. 1,037,547 discloses a process for continuous, homogeneous incorporation into plastics melts of substances to be finely dispersed therein. The process entails introducing into an extruder a metered stream of, for example, a dye concentrate at the first feed inlet, introducing a molten stream of plastic containing volatile constituents at the second feed inlet, and passing the resulting mixture through a degassing chamber. Subsequent to degassing, additional liquid components are introduced into the mixture and homogeneously dispersed therein.

Further, U.S. Pat. No. 4,649,005 discloses a method for preparing filled silicone rubber bases without plasticizer by passing all of the filler together with from 30 to 100 percent of the total weight of the polyorganosiloxane ingredient of the base through the first kneading section of a compounding extruder and adding any remaining polyorganosiloxane before passing the composition through a second kneading section of the compounding extruder. The two kneading sections are maintained at temperatures of from 200° to 300° C. The disclosure of this patent is totally incorporated herein by reference.

In addition, U.S. Pat. No. 4,621,039 discloses a toner composition comprising resin particles and pigment particles surface treated with amine or ammonium salt charge enhancing additives, wherein the charge enhancing additives are associated with the pigment particles and are present as a continuous coating on the pigment particles. This association of the charge enhancing additives with the pigment particles is effected by mixing the pigment particles and the charge enhancing additives prior to adding the resulting mixture to the polymer resin particles, as set forth in column 6, lines 56 et seq., and results in a toner composition enabling rapid admix times. The process entails treating the pigment particles with a solution of the charge enhancing additive dissolved in a suitable solvent, and subsequently removing the solvent, thereby resulting in pigment particles with permanently attached charge control additives, as set forth at columns 6 and 7, bridging paragraph. In contrast, the present invention entails premixing of the charge control additive and the pigment particles in the absence of a solvent.

Copending application U.S. Ser. No. 630,797, entitled "Process and Apparatus for Preparing Toner Particles," the disclosure of which is totally incorporated herein by reference, discloses an apparatus for lowering the melt temperature of a toner formulation which comprises, in operative relationship, a toner processing apparatus and a means for injecting liquid components therein. Also disclosed in this application is a process for lowering the melt temperature of a toner formulation, generally by from about 10° F. to about 60° F., which comprises providing a toner processing apparatus, adding thereto toner resin particles and pigment particles, mixing and melting the particles, and injecting into the formulation components with a boiling point lower than the melting temperature of the resin particles, thereby enabling more effective dispersion of the pigment particles in the other toner components. The disclosure of this application is totally incorporated herein by reference.

Although known processes for preparing electrophotographic toners are suitable for their intended purposes, a need continues to exist for processes for preparing toners. More specifically, a need exists for improved processes for preparing electrophotographic toners by an extrusion process wherein the resulting toner may be charged to triboelectric levels exceeding the triboelectric charging values of toners of the same composition that have been prepared by known extrusion processes. A need also exists for toner preparation processes that mix the pigment and the charge control additive prior to being mixed with the toner resin, thereby allowing the charge control additive and the pigment to undergo a significant amount of interaction. Further, there is a need for toner preparation processes that can be carried out in a standard extruder, with no need to modify the extruder, and that also produces toner that may be charged to higher triboelectric levels than toners of the same composition that have been prepared by conventional extrusion processes. In addition, a need exists for simple and economical methods of preparing electrophotographic toners. There is also a need for a method of preparing toners wherein the pigment and the charge control additive are permitted to interact in the absence of a solvent, enabling interaction between the pigment and charge control additive.

SUMMARY OF THE INVENTION

It is an object of the present invention to provide a process for preparing electrophotographic toners.

Another object of the present invention is to provide a process for preparing electrophotographic toners by an extrusion process wherein the resulting toner may be charged to triboelectric levels exceeding the triboelectric charging values of toners of the same composition that have been prepared by known extrusion processes.

Still another object of the present invention is to provide a toner preparation process that includes mixing the pigment and the charge control additive well prior to being mixed with the toner resin, thereby allowing the charge control additive and the pigment to undergo a significant amount of interaction.

It is another object of the present invention to provide a toner preparation process that can be carried out in a standard extruder, with no need to modify the extruder, and that also produces toner that may be charged to higher triboelectric levels than toners of the same composition that have been prepared by other extrusion processes.

It is yet another object of the present invention to provide a simple and economical method of preparing electrophotographic toners.

Another object of the present invention is to provide a method for preparing toners wherein the pigment and the charge control additive are permitted to interact in the absence of a solvent.

Still another object of the present invention is to provide a toner preparation process that does not employ charge control additive in solution form and therefore generates no waste or solvent disposal problems.

These and other objects of the invention are achieved by providing a process for preparing a toner composition which comprises premixing a pigment and a charge control additive in the absence of a solvent, subsequently admixing a resin and the premixed pigment and charge control additive, and extruding the pigment, charge control additive, and resin. In one embodiment of the invention, the pigment and the charge control additive are premixed prior to being added to the extruder. In another embodiment of the invention, the pigment and charge control additive are premixed by adding them to the extruder via a first upstream supply means and extruding them, and the resin is subsequently added to the extruder via a supply means downstream of the first supply means. Optionally, an additional amount of the pigment may be added with the resin, which additional pigment has not been mixed with the charge control additive.

DETAILED DESCRIPTION OF THE INVENTION

Figure 1:
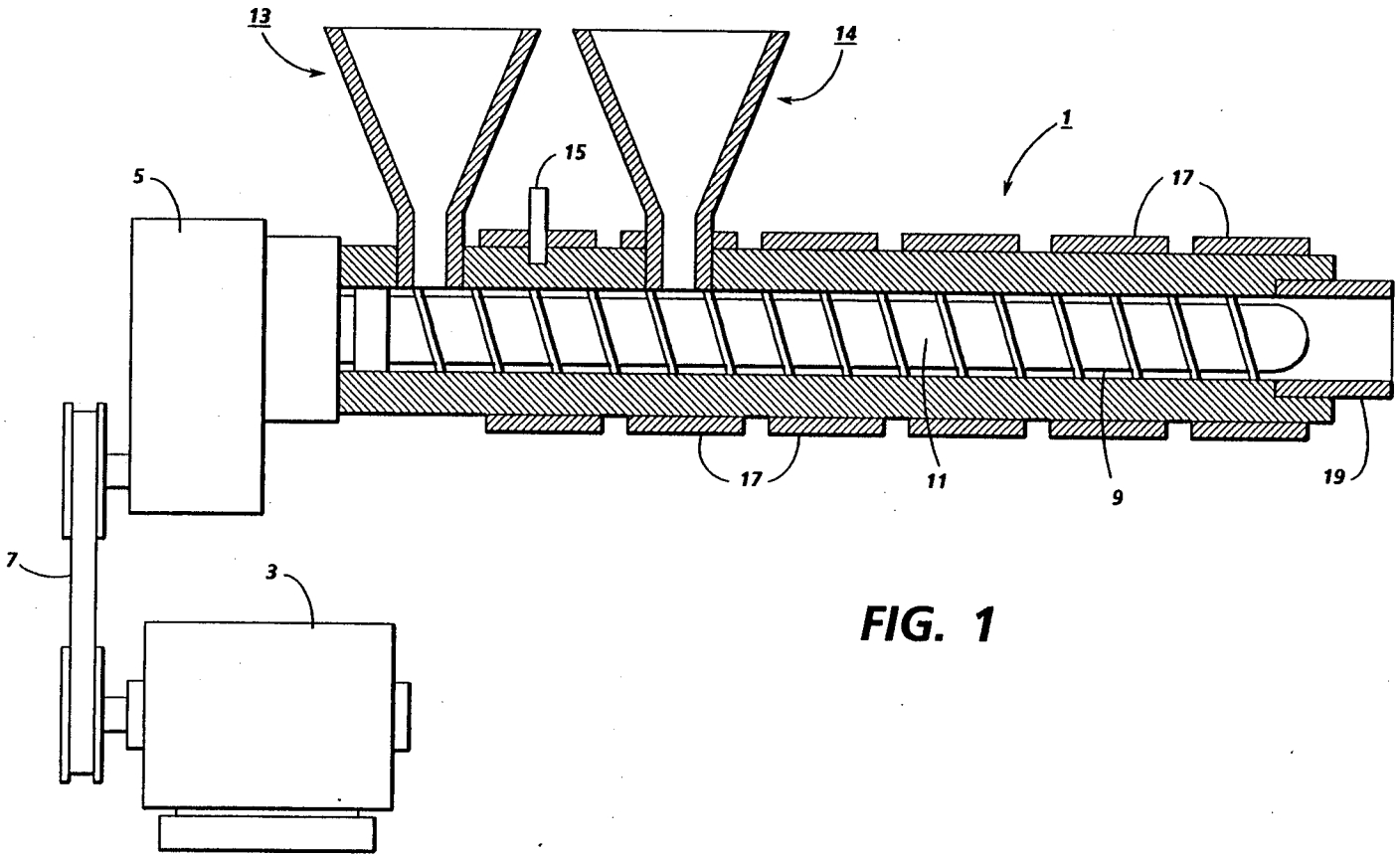
FIG. 1 is a partially schematic cross-sectional view of a toner extrusion apparatus suitable for the process of the present invention.

The process of the present invention entails the use of an extruder. Generally, any extruder suitable for preparing electrophotographic toners may be employed, provided that the objectives of the present invention are achieved, such as single screw extruders or twin screw extruders. For example, one suitable extruder is the DAVO Extruder, available from DAVO GMBH & Company, Troisdorf, West Germany, which is an intermeshing counter-rotating twin screw extruder with a screw diameter of 22 millimeters and a length to diameter (L/D) ratio of 23.2. Another suitable apparatus is the ZSK-30 Extruder, available from Werner & Pfleiderer Corporation, Ramsey, New Jersey, which is an intermeshing co-rotating twin screw extruder with a screw diameter of 30.7 millimeters and an L/D ratio of 28.3, extendable to 37.2. For a better understanding of the present invention, a typical toner extrusion apparatus suitable for the process of the present invention is illustrated in FIG. 1.

Illustrated in FIG. 1 is a twin screw extrusion device 1 containing a drive motor means 3, a gear reducer means 5, a belt means 7, a blending chamber 9, a screw means 11, upstream supply means or hopper 13, downstream supply means or hopper 14, a thermocouple means 15, a heating means 17, and a die or head pressure means 19. In operation, the components to be extruded, such as toner resin particles, pigment particles, and pigment/charge control additive preblend, enter the extrusion apparatus from the first upstream supply means 13 and the second downstream supply means 14. In one embodiment of the invention, the pigment and charge control additive are preblended prior to being added to the extruder, and the preblend, the resin, and, optionally, additional pigment may be added through either upstream supply means 13, downstream supply means 14, or both supply means. In another embodiment of the invention, the pigment and charge control additives are both added to the extruder through upstream supply means 13 and extruded, and the resin and, optionally, additional pigment, are subsequently added to the extruder through downstream supply means 14. The components are blended and mixed thoroughly in chamber 9 by rotation of screw 11. Blending usually takes place at elevated temperatures controlled by heating means 17.

With further reference to FIG. 1, the speed of the screw 11 can be of any suitable value provided that the objectives of the present invention are achieved. Generally, the speed of screw 11 is from about 50 revolutions per minute to about 300 revolutions per minute. The temperature, which is controlled by a thermocouple 15 and generated by heating means 17, is from about 80° C. to about 200° C. The die or head pressure 19 generates pressure of from about 50 pounds per square inch to about 500 pounds per square inch. In one embodiment, the screw is allowed to rotate at about 200 revolutions per minute, the temperature in the chamber 11 is maintained at about 130° C., and the die or head pressure is about 50 pounds per square inch.

Parameters associated with the blending chamber, including the amount of polymer resin particles, pigment particles, and charge control additives introduced therein, can be controlled by sampling the toner composition product obtained subsequent to processing, as is commonly done with the Banbury mill mixing apparatus.

Toners are prepared according to the process of the present invention by blending the charge control additive and the pigment components together prior to introduction of the polymeric resin component. While not being limited to a specific theory, it is believed that interaction between the charge control additive and the pigment results in a toner composition with desirable triboelectric charging values. Accordingly, preblending of the charge control additive with the pigment prior to addition of the resin promotes this interaction and results in a toner composition that may be charged to higher triboelectric levels than toner compositions prepared by blending all three components in the extruder simultaneously.

Physical preblending of the charge control additive with the pigment may be accomplished by several methods. For example, the two materials can be melt blended for from about 1 to about 8 minutes in a batch internal mixer or in a continuous compounding extruder. The latter method may be combined readily with the overall extrusion process by providing a side extruder or by employing a two stage extruder, such as the Werner & Pfleiderer ZSK-30 Extruder, which has various barrel sections that can be configured to enable material feeding at a downstream location and different screw elements that can be arranged for the particular process. When the charge control additive and pigment are pre-blended prior to being added to the extruder, the charge control additive and pigment are mixed at a temperature of from about 80° C. to about 150° C., and preferably at from about 100° C. to about 120° C., for from about 1 to about 8 minutes to result in a pigment-charge control additive preblend. The preblend is then reduced to small particles, generally of from about 20 to about 150 microns, using a mechanical comminuting device. The preblend particles, toner resin and, if desired, fresh pigment can subsequently be added to an extruder for toner preparation. By fresh pigment is meant pigment that has not been preblended with a charge control additive. Alternatively, the process may be performed by preblending the charge control agent and the pigment in the upstream portion of the extruder by adding these components to the feed section of the extruder. Melt blending of the toner composition is then performed by addition of the polymeric resin and, if desired, fresh pigment to a downstream feed port of the extruder. When the charge control additive and pigment are preblended prior to being added to the extruder, the charge control additive and pigment are mixed at a temperature of from about 80° C. to about 150° C., and preferably at from about 100° C. to about 120° C., for from about 1 to about 8 minutes. Extrusion then takes place at from about 100° C. to about 200° C., and preferably at from about 100° C. to about 150° C. for from about 2 to about 8 minutes.

In a preferred embodiment of the invention, preblending of the pigment and charge control additive entails mixing from about 50 to about 70 parts of the charge control additive with from about 30 to about 50 parts of the pigment to obtain a preblend. Subsequently, the toner is prepared in the extruder by mixing from about 2 to about 5 parts of the preblended pigment and charge control additive with from about 85 to about 98 parts of the resin and from 0 to about 10 parts of fresh pigment.

Toner particles prepared according to the process of the present invention comprise a resin, a charge control additive, and a pigment. Examples of suitable toner resins include polyimides, epoxies, diolefins, polyurethanes, vinyl resins, and polymeric esterification products of a dicarboxylic acid and a diol comprising a diphenol. Any suitable vinyl resin may be selected for the toner resins of the present application, including homopolymers or copolymers of two or more vinyl monomers. Typical of such vinyl monomeric units include: styrene, p-chlorostyrene, vinyl naphthalene, unsaturated mono-olefins such as ethylene, propylene, butylene, and isobutylene; vinyl halides such as vinyl chloride, vinyl bromide, vinyl fluoride, vinyl acetate, vinyl propionate, vinyl benzoate, vinyl butyrate, and the like; vinyl esters such as esters of monocarboxylic acids including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylimide; vinyl ethers, such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; styrene butadiene copolymers, Pliolites®, available from Goodyear Company, and mixtures thereof. Particularly preferred are a resin comprising poly-n-butylmethacrylate, a copolymer of styrene and butadiene which comprises 89 percent by weight of styrene and 11 percent by weight of butadiene, and a copolymer of styrene and n-butyl methacrylate which comprises 58 percent by weight of styrene and 42 percent by weight of n-butyl methacrylate. The resin or resins are generally present in an amount of from about 30 to about 99 percent by weight of the toner composition, preferably from about 50 to about 99 percent by weight, and more preferably from about 70 to about 95 percent by weight, although they may be present in greater or lesser amounts, provided that the objectives of the invention are achieved.

Various suitable pigment particles can be employed, including carbon black, magnetites consisting of a mixture of magnetic oxides, including the commercially available Mapico blacks, nigrosine dyes, colored pigments such as cyan, magenta, yellow, blue, green, brown, and the like, and mixtures thereof, with carbon black, such as Regal 330® carbon black, being the preferred colorant. These pigment particles are present in the toner composition in an amount of from about 3 percent by weight to about 20 percent by weight. When the pigment articles are magnetites, they are present in the toner composition in the amount of from about 10 percent by weight to about 70 percent by weight, and preferably in an amount of from about 20 percent by weight to about 50 percent by weight.

Illustrative examples of magenta materials that may be included in the toner composition include 2,9-dimethyl-substituted quinacridone, an anthraquinone dye identified in the Color Index as CL 60710; CL Dispersed Red 15, a diazo dye identified in the Color Index as CL 26050; C Solvent Red 19, and the like. Illustrative examples of cyan materials that may be used as pigments include copper tetra 4(octadecyl sulfonamido) phthalocyanine; X-copper phthalocyanine pigment listed in the Color Index as CL 74160; CL Pigment Blue; Anthrathrene Blue, identified in the Color Index as CL69810; and Special Blue X-2137. Examples of yellow pigments that may be employed include diarylide yellow 3,3-dichlorobenzidene acetoacetanilides, a monoazo pigment identified in the Color Index as CL 12700; CL Solvent Yellow 16; a nitrophenyl amine sulfonimide identified in the Color Index as Foron Yellow SE/GLN, CL Dispersed Yellow 33; 2,5-dimethoxy-4-sulfonanilide phenylazo-4'-chloro-2,5-dimethoxy aceto-acetanilide, Permanent Yellow FGL, and other similar yellows. The pigments of cyan, magenta, and yellow, when used with the charge enhancing additives, are generally present in the toner composition in an amount of from about 2 weight percent to about 15 weight percent based on the weight of the toner resin particles.

Various known suitable effective charge control additives can be incorporated into the toner compositions of the present invention, such as quaternary ammonium compounds, alkyl pyridinium compounds, including cetyl pyridinium halides and cetyl pyridinium tetrafluoborates, as disclosed in U.S. Pat. No. 4,298,672, the disclosure of which is totally incorporated herein by reference, organic sulfate and sulfonate compounds, as disclosed in U.S. Pat. No. 4,338,390, the disclosure of which is totally incorporated herein by reference, distearyl dimethyl ammonium methyl sulfate, and the like. Particularly preferred as a charge control agent is cetyl pyridinium chloride. The charge enhancing additives are usually present in the final toner composition in an amount of from about 1 percent by weight to about 20 percent by weight.

Optionally, external additives may also be present on the toners obtained with the process of the present invention. External additives are applied, for example, in instances such as when toner flow is to be assisted, or when lubrication is needed to assist a function such as cleaning of the photoreceptor. The amounts of external additives are measured in terms of percentage by weight of the toner composition, but are not themselves included when calculating the percentage composition of the toner. For example, a toner composition containing a resin, a pigment, and an external additive may comprise 80 percent by weight resin and 20 percent by weight pigment; the amount of external additive present is reported in terms of its percent by weight of the combined resin and pigment. External additives may include any additives suitable for use in electrostatographic toners, including fumed silica, silicon derivatives such as Aerosil R972®, available from Degussa, Inc., ferric oxide, hydroxy terminated polyethylenes such as Unilin, polyolefin waxes, which preferably are low molecular weight materials, including those with a molecular weight of from about 1,000 to about 20,000, and including polyethylenes and polypropylenes, polymethylmethacrylate, zinc stearate, chromium oxide, aluminum oxide, titanium oxide, stearic acid, polyvinylidene fluorides such as Kynar®, and other known or suitable additives. External additives may be present in any amount, provided that the objectives of the present invention are achieved, and preferably are present in amounts of from about 0.1 to about 1 percent by weight. For the process of the present invention, these additives generally are introduced into the toner composition after the toner particles have been prepared and classified by size.

Subsequent to extruding the toner components, the extruded material is reduced in size. For example, the extruded material may be reduced to pellet form using any of the pelletizers commercially available, such as the Berlyn Pelletizer, available from Berlyn Corporation, or pelletizers available from Cumberland Inc. or Conair Inc. In one embodiment the extrudate, in the form of strands, is cooled and solidified by passing it through a cold water tank. A pelletizer then dries the strands and cuts them into pellets. Afterwards, the pellets are broken into smaller particles about 1 millimeter in average particle diameter using a mechanical comminuting device. The coarse particles so obtained are then reduced into smaller toner size particles of about 10–20 microns in average diameter by employing a fine grinding device such as a fluid energy mill. A classification step is then carried out to narrow the particle size distribution, resulting in a toner composition with particles that range in particle diameter from about 1 to about 30 microns, with the mean particle diameter being from about 10 to about 20 microns. Subsequent to classification of the toner particles, any external additives are blended with the toner particles.

Thereafter, the resulting toner can be formulated into a two-component developer by mixing with carrier particles. Illustrative examples of carrier particles than can be mixed with the toner composition prepared according to the present invention include those carriers capable of obtaining a triboelectric charge of opposite polarity to that of the toner particles. Accordingly, in one embodiment the carrier particles are selected so as to be of a negative polarity in order that the toner particles which are positively charged will adhere to and surround the carrier particles. Illustrative examples of such carrier particles include granular zircon, granular silicon, steel, nickel, iron ferrites, and the like. Additionally, the carrier particles can be nickel berry carriers as disclosed in U.S. Pat. No. 3,847,604, the disclosure of which is totally incorporated herein by reference, which comprise nodular carrier beads of nickel, characterized by surfaces of reoccurring recesses and protrusions which provide the particles with a relatively large external area.

The selected carrier particles can be used with or without a coating, the coating generally comprising fluoropolymers, such as polyvinylidene fluoride resins, terpolymers of styrene, methylmethacrylate, a silane, such as triethoxy silane, tetrafluoroethylenes, other known coatings and the like.

The carrier particles generally have an average diameter of from about 50 microns to about 1,000 microns, allowing these particles to possess sufficient density and inertia to avoid adherence to the electrostatic images during the development process. The carrier particles can be mixed with the toner particles in various suitable combinations. Preferably, about 1 part per toner to about 10 parts to about 200 parts by weight of carrier are mixed.

The following examples are illustrative in nature and are not intended to limit the scope of the invention. Other embodiments may occur to those skilled in the art. Parts and percentages are by weight unless otherwise indicated.

EXAMPLE I

A toner composition comprising about 6 percent by weight of Regal 330® carbon black pigment, about 1 percent by weight of cetyl pyridinium chloride as a charge control additive, and about 93 percent by weight of a styrene-n-butyl methacrylate resin containing about 58 percent by weight of styrene and about 42 by weight n-butylmethacrylate was prepared as follows.

A cetyl pyridinium chloride (CPC) charge control additive and Regal 330®, carbon black were preblended in a DAVO extruder. The feed rate of CPC was 1 pound per hour and that of carbon black was 0.72 pound per hour. The temperature of the three barrel sections were maintained at 105° C., 115° C., and 115° C., and the die head was maintained at 115° C. The rotational speed of the screws was 80 revolutions per minute. After extrusion the strands were ground in a Model J Fitzmill to below 150 microns in average diameter. The resulting preblend was then fed into a ZSK-30 extruder at 0.34 pound per hour, together with the styrene-n-butyl mathacrylate copolymer at 18.60 pounds per hour and additional Regal 330® carbon black at 1.06 pounds per hour. The temperatures of the barrel sections were all kept at 130° C. and the screw rotational speed was 200 revolutions per minute (rpm). After extrusion, the extruded pellets were made into toner particles about 11 microns in average particle diameter by grinding, jetting and classification. Triboelectrical characteristics of this toner were measured against a carrier comprising a steel core coated with polyvinylidene fluoride (commercially available as Kynar®) at a coating weight of about 0.15 percent of the total carrier particle, wherein the particles had an average particle diameter of from about 100 to about 120 microns. A developer composition comprising about 3 percent by weight of the toner and about 97 percent by weight of the carrier resulted in a triboelectric charge on the toner of 29.8 microcoulombs per gram, as determined by the Faraday cage method.

EXAMPLE II

A toner composition comprising about 6 percent by weight of Regal 330® carbon black pigment, about 1 percent by weight of cetyl pyridinium chloride as a charge control additive, and about 93 percent by weight of a styrene-n-butyl methacrylate resin containing about 58 percent by weight of styrene and about 42 percent by weight n-butylmethacrylate was prepared as follows.

A cetyl pyridinium chloride charge control additive and Regal 330® carbon black were fed to the upstream feed port of a ZSK-30 extruder at rates of 0.20 and 0.14 pound per hour, respectively. The styrene copolymer and additional Regal 330® were fed to a downstream feed port located at the 4th barrel section at rates of 18.60 and 1.06 pounds per hour, respectively. The temperatures of the barrel sections were kept at a profile of 100° C., 80° C., 95° C., 130° C., 130° C., 130° C., 130° C., and 130° C. The rotational speed of the screws was 300 revolutions per minute. After post-extrusion operations, a toner of 11.4 microns in average particle diameter was obtained. Triboelectrical characteristics of this toner were measured against a carrier comprising a steel core coated with polyvinylidene fluoride (commercially available as Kynar®) at a coating weight of about 0.15 percent of the total carrier particle, wherein the particles had an average particle diameter of from about 100 to about 120 microns. A developer composition comprising about 3 percent by weight of the toner and about 97 percent by weight of the carrier resulted in a triboelectric charge on the toner of 32.2 microcoulombs per gram, as determined by the Faraday cage method.

EXAMPLE III

A toner composition comprising about 6 percent by weight of Regal 330® carbon black pigment, about 2 percent by weight of cetyl pyridinium chloride as a charge control additive, and about 92 percent by weight of a styrene-n-butyl methacrylate resin containing about 58 percent by weight of styrene and about 42 percent by weight n-butylmethacrylate was prepared as follows.

A cetyl pyridinium chloride charge control additive and Regal 330® carbon black were fed to the upstream feed port of a ZSK-30 extruder at rates of 0.40 and 0.29 pounds per hour, respectively. The styrene copolymer and Regal 330® were fed to a downstream feed port located at the 4th barrel section at rates of 18.40 and 0.91 pounds per hour, respectively. The temperatures of the barrel sections were kept at a profile of 100° C., 80° C., 95° C., 130° C., 130° C., 130° C., 130° C., and 130° C. The rotational speed of the screws was 300 revolutions per minute. A toner of 11.6 microns in average particle diameter was obtained subsequent to micronization and classification procedures. Triboelectrical characteristics of this toner were measured against a carrier comprising a steel core coated with polyvinylidene fluoride (commercially available as Kynar®) at a coating weight of about 0.15 percent of the total carrier particle, wherein the particles had an average particle diameter of from about 100 to about 120 microns. A developer composition comprising about 3 percent by weight of the toner and about 97 percent by weight of the carrier resulted in a triboelectric charge on a toner of 29.5 microcoulombs per gram, as determined by the Faraday cage method.

COMPARATIVE EXAMPLE I

To further demonstrate the advantage of promoting pigment-charge control additive interaction through preblending, a toner composition comprising about 6 percent by weight of Regal 330® carbon black pigment, about 1 percent by weight of cetyl pyridinium chloride as a charge control additive, and about 93 percent by weight of a styrene-n-butyl methacrylate resin containing about 58 percent by weight of styrene and about 42 percent by weight n-butylmethacrylate was prepared without the preblending step. The styrene copolymer, cetyl pyridinium chloride and Regal 330® were fed to the same feed port located at the first barrel section of the ZSK-30 extruder at rates of 18.6 pounds per hour, 0.2 pound per hour, and 1.2 pounds per hour, respectively. After grinding, jetting and classification, a toner of 11.2 microns in average particle diameter was obtained. Triboelectrical characteristics of this toner were measured against a carrier comprising a steel core coated with polyvinylidene fluoride (commercially available at Kynar®) at a coating weight of about 0.15 percent of the total carrier particle, wherein the particles had an average particle diameter of from about 100 to about 120 microns. A developer composition comprising about 3 percent by weight of the toner and about 97 percent by weight of the carrier resulted in a triboelectric charge on the toner of 24.7 microcoulombs per gram, as determined by the Faraday cage method, which was lower than the triboelectric charge value of the toner of the same composition prepared according to the process of the present invention as illustrated in Example I.

The above examples are illustrative in nature, and the invention is not limited to the specific embodiments. Those skilled in the art will recognize variations and modifications that may be made which are within the scope of the following claims.

What is claimed is:

1. A process for preparing a toner composition which comprises (1) premixing a pigment and a charge control additive in the absence of a solvent; (2) subsequently admixing the premixed pigment and charge control additive obtained in step 1 with a resin; and (3) extruding the mixture of pigment, charge control additive, and resin obtained in step 2.

2. A process in accordance with claim 1 wherein the pigment and the charge control additive are premixed prior to being added to the extruder.

3. A process in accordance with claim 1 wherein the pigment and charge control additive are premixed by adding them to the extruder via a first upstream supply means and extruding them, and the resin is subsequently added to the extruder via a second supply means downstream of the first supply means.

4. A process in accordance with claim 2 wherein an additional amount of fresh pigment is added with the resin.

5. A process in accordance with claim 2 wherein the pigment and the charge control additive are premixed for from about 1 to about 8 minutes prior to the addition of the resin.

6. A process in accordance with claim 2 wherein the pigment is selected from the group consisting of carbon black, magnetites, cyan pigments, magenta pigments, yellow pigments, blue pigments, green pigments, brown pigments, and mixtures thereof.

7. A process in accordance with claim 2 wherein the resin is selected from the group consisting of polyimides, epoxies, diolefins, polyurethanes, vinyl resins, and esterification products of a di-acid and a diol.

8. A process in accordance with claim 2 wherein the charge control additive is selected from the group consisting of quaternary ammonium compounds, alkyl pyridinium compounds, organic sulfate compounds, and organic sulfonate compounds.

9. A process in accordance with claim 2 wherein the mixture of resin, pigment, and charge control additive is extruded for from about 2 to about 8 minutes after the resin is added.

10. A process in accordance with claim 2 wherein the pigment and the charge control additive are premixed at a temperature of from about 80° C. to about 150° C.

11. A process in accordance with claim 2 wherein the mixture of pigment, charge control additive, and resin is extruded at a temperature of from 100° C. to about 200° C.

12. A process in accordance with claim 3 wherein an additional amount of fresh pigment is added with the resin.

13. A process in accordance with claim 3 wherein the pigment and the charge control additive are premixed for from about 1 to about 8 minutes prior to the addition of the resin.

14. A process in accordance with claim 3 wherein the pigment is selected from the group consisting of carbon black, magnetites, cyan pigments, magenta pigments, yellow pigments, blue pigments, green pigments, brown pigments, and mixtures thereof.

15. A process in accordance with claim 3 wherein the resin is selected from the group consisting of polyimides, epoxies, diolefins, polyurethanes, vinyl resins, and esterification products of a di-acid and a diol.

16. A process in accordance with claim 3 wherein the charge control additive is selected from the group consisting of quaternary ammonium compounds, alkyl pyridinium compounds, organic sulfate compounds, and organic sulfonate compounds.

17. A process in accordance with claim 3 wherein the mixture of resin, pigment, and charge control additive is extruded for from about 2 to about 8 minutes after the resin is added.

18. A process in accordance with claim 3 wherein the pigment and the charge control additive are premixed at a temperature of from about 80° C. to about 150° C.

19. A process in accordance with claim 3 wherein the mixture of pigment, charge control additive, and resin is extruded at a temperature of from about 100° C. to about 200° C.

20. A process for preparing an electrophotographic toner composition which comprises (1) premixing carbon black and cetyl pyridinium chloride in the absence of a solvent; (2) subsequently admixing the premixed carbon black and cetyl pyridinium chloride obtained in step 1 with a styrene-n-butyl methacrylate copolymer resin; and (3) extruding the mixture of carbon black, cetyl pyridinium chloride, and copolymer resin obtained in step 2.

21. A process in accordance with claim 20 wherein the carbon black and the cetyl pyridinium chloride are premixed prior to being added to the extruder.

22. A process in accordance with claim 20 wherein the carbon black and cetyl pyridinium chloride are premixed by adding them to the extruder via an upstream supply means and extruding them, and the copolymer resin is subsequently added to the extruder via a downstream supply means.

23. A process in accordance with claim 20 wherein an additional amount of fresh carbon black is added with the copolymer resin.

24. A process in accordance with claim 20 wherein the carbon black and the cetyl pyridinium chloride are premixed for from about 1 to about 8 minutes prior to the addition of the copolymer resin.

25. A process in accordance with claim 20 wherein the mixture of copolymer resin, carbon black, and cetyl pyridinium chloride is extruded for from about 2 to about 8 minutes after the resin is added.

26. A process in accordance with claim 20 wherein the carbon black and the cetyl pyridinium chloride are premixed at a temperature of from about 80° C. to about 150° C.

27. A process in accordance with claim 20 wherein the mixture of carbon black, cetyl, pyridinium chloride, and copolymer resin is extruded at a temperature of from about 100° C. to about 200° C.

28. A process for preparing an electrophotographic toner composition which comprises (1) premixing carbon black and cetyl pyridinium chloride in the absence of a solvent for from about 1 to about 8 minutes at a temperature of from about 80° C. to about 150° C.; (2) subsequently adding a styrene-n-butyl methacrylate copolymer resin to the premixed carbon black and cetyl pyridinium chloride obtained in step 1; (3) extruding the mixture of carbon black, cetyl pyridinium chloride, and copolymer resin obtained in step 2 at a temperature of from about 100° C. to about 200° C. for from about 2 to about 8 minutes; (4) subsequently recovering the product obtained; and (5) reducing the product to particles with an average particle diameter of from about 10 to about 20 microns in average diameter.

29. A process in accordance with claim 2 wherein the product recovered from the extruder is reduced to particles of from about 10 to about20 microns in average diameter.

30. A process in accordance with claim 3 wherein the product recovered from the extruder is reduced to particles of from about 10 to about 20 microns in average diameter.

31. A process in accordance with claim 20 wherein the product recovered from the extruder is reduced to particles of from about 10 to about 20 microns in average diameter.

32. A process in accordance with claim 2 wherein extrusion is effected by rotation of a screw at from about 50 to about 300 revolutions per minute.

33. A process in accordance with claim 3 wherein extrusion is effected by rotation of a screw at from about 50 to about 300 revolutions per minute.

34. A process in accordance with claim 20 wherein extrusion is effected by rotation of a screw at from about 50 to about 300 revolutions per minute.

35. Process in accordance with claim 28 wherein extrusion is effected by rotation of a screw at from about 50 to about 300 revolutions per minute.

* * * * *